United States Patent [19]

Adams et al.

[11] 4,395,144

[45] Jul. 26, 1983

[54] APPARATUS FOR PRINTING ALPHANUMERIC INFORMATION ON PHOTOGRAPHIC SLIDE MOUNTS

[75] Inventors: Daniel O. Adams, Blaine; Gregg S. Beckman, St. Louis Park, both of Minn.

[73] Assignee: Pako Corporation, Minneapolis, Minn.

[21] Appl. No.: 341,296

[22] Filed: Jan. 21, 1982

[51] Int. Cl.[3] ..... B41J 3/10; B41F 17/00

[52] U.S. Cl. ..... 400/30; 400/124; 101/35; 101/44; 29/33 K

[58] Field of Search ..... 400/124, 126, 30, 32; 101/93.04, 35, 41–44, 232, 233, 235, DIG. 3; 29/417, 33 K; 53/435, 520

[56] References Cited

U.S. PATENT DOCUMENTS

| | | | |
|---|---|---|---|
| 2,547,602 | 4/1951 | Schmitt | 101/44 |
| 3,341,960 | 9/1967 | Florjancic et al. | 40/152 |
| 3,470,642 | 10/1969 | Mundt et al. | 40/152 |
| 3,478,456 | 4/1968 | Mundt et al. | 40/152 |
| 3,524,299 | 8/1970 | Mundt et al. | 53/23 |
| 3,562,074 | 2/1971 | Mundt et al. | 156/580 |
| 3,570,342 | 3/1971 | Mundt | 83/93 |
| 3,614,854 | 10/1971 | Mundt et al. | 53/381 R |
| 3,738,260 | 6/1973 | Nari et al. | 101/35 |
| 3,788,031 | 1/1974 | Florjancic | 53/123 |
| 3,807,121 | 4/1974 | Mundt et al. | 53/23 |
| 3,838,250 | 9/1974 | Naas et al. | 101/93.04 |
| 3,867,882 | 2/1975 | Ahlgren et al. | 101/35 |
| 3,911,813 | 10/1975 | Schaeffer | 101/44 X |
| 3,943,029 | 3/1976 | Mundt et al. | 156/443 |
| 3,977,280 | 8/1976 | Mundt et al. | 83/443 |
| 4,004,340 | 1/1977 | Urban | 29/417 |
| 4,102,029 | 7/1978 | Thompson | 29/417 |
| 4,122,457 | 10/1978 | Erikson et al. | 400/126 X |
| 4,135,343 | 1/1979 | Urban et al. | 53/435 |
| 4,203,679 | 5/1980 | Duerr et al. | 400/124 X |
| 4,208,137 | 6/1980 | Liu | 400/124 |
| 4,284,362 | 8/1981 | Jackson et al. | 400/124 |

OTHER PUBLICATIONS

Manual of Loersch Corp., "Diamount 2000 Professional".

Brochure of Loersch Corp. "Diamount 2000 Professional".

Brochure of Loersch Corp., "Quickpoint Diatyper".

Brochure of Loersch Corp., "Quickpoint Supermini".

Brochure of Byers Photo Equipment Co., "Byers Automounter V".

Brochure of Byers Photo Equipment Co., "Byers Date and Numbering Imprinter".

Brochure of Byers Photo Equipment Co., "Byers Dot Matrix Imprinter".

*Primary Examiner*—Clifford D. Crowder

*Attorney, Agent, or Firm*—Kinney, Lange, Braddock, Westman & Fairbairn

[57] ABSTRACT

A data printing apparatus for printing alphanumeric information on photographic slide mounts includes a slide track along which the photographic slide mounts are advanced. When the slide mount is positioned at a printing station along the slide track, a movable print head prints alphanumeric characters on the slide mount. The print head is carried on a carriage, which in turn is movable on a carriage track. The carriage track is aligned in a plane parallel to a plane defined by the slide track and runs in a generally transverse direction to the slide track, so that the print head moves transversely to the longitudinal direction of the slide track as a carriage drive moves the carriage on the carriage track. The data printing apparatus includes a control system which controls operation of the print head and the carriage drive as a function of signal pulses which represent increments of motion of the carriage and as a function of stored data representative of the alphanumeric information to be printed on the slide mount.

16 Claims, 9 Drawing Figures

Fig. 1
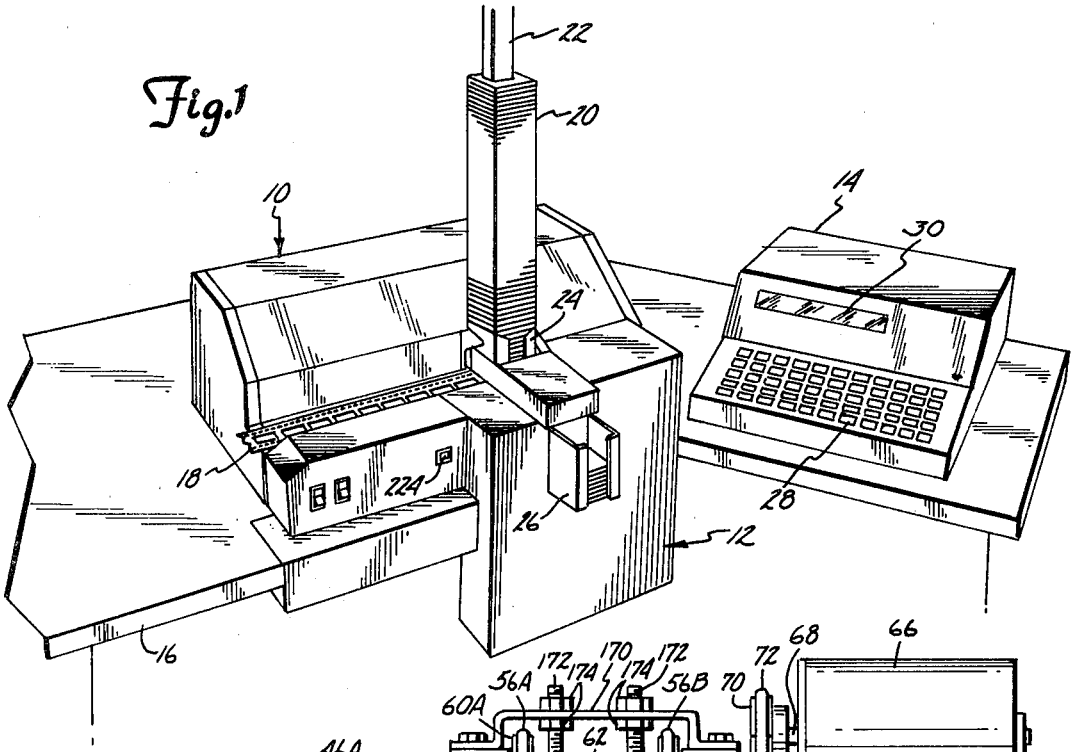
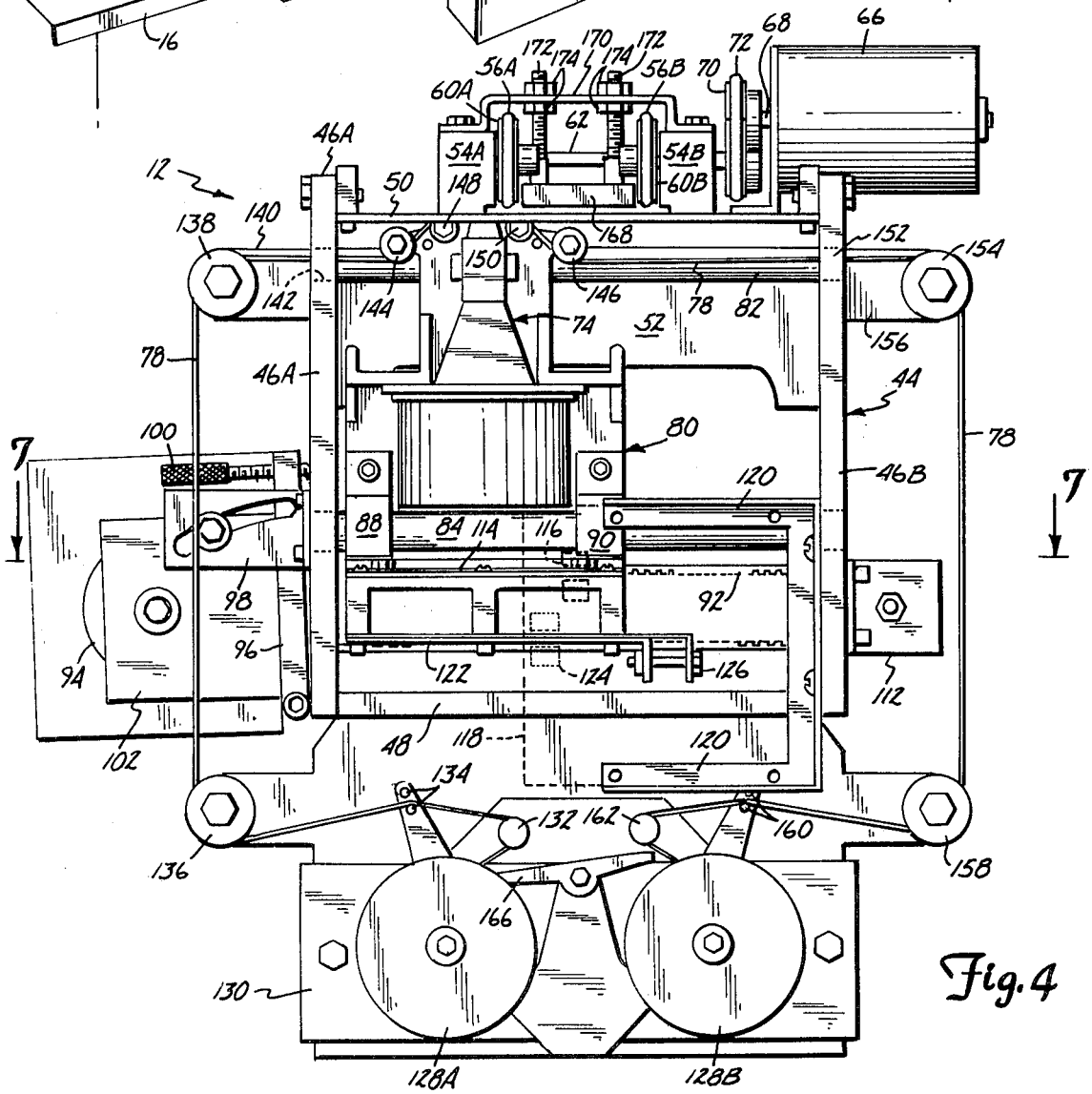
Fig. 4

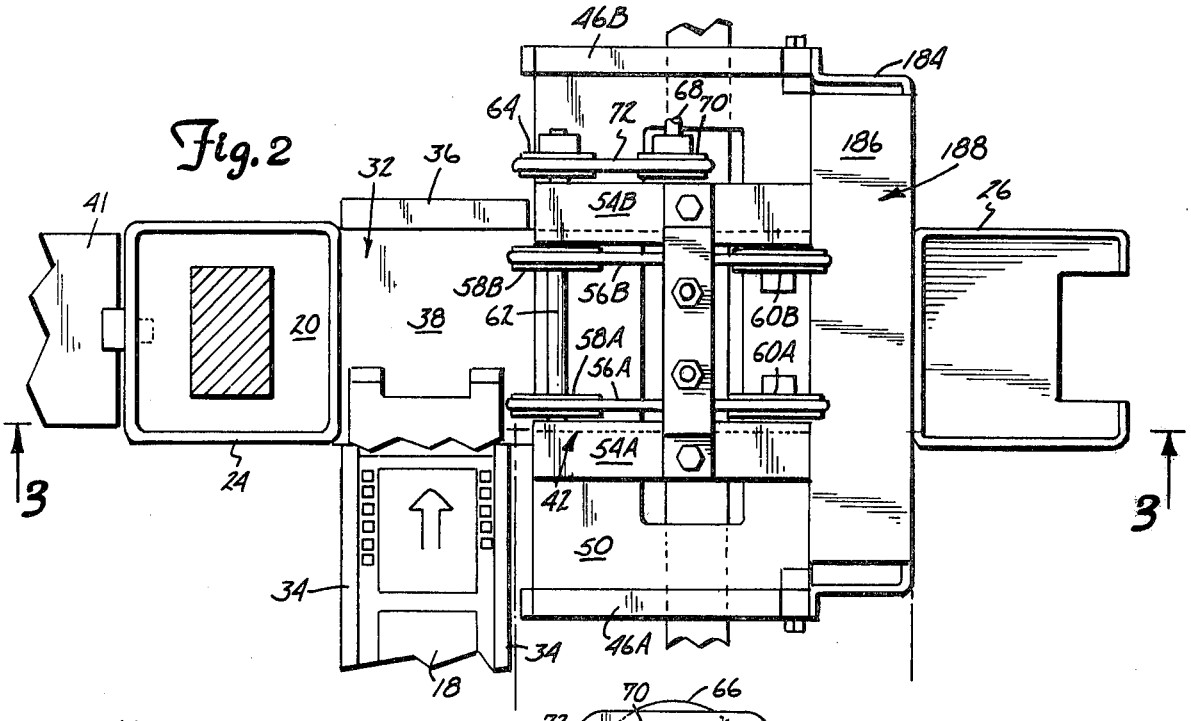
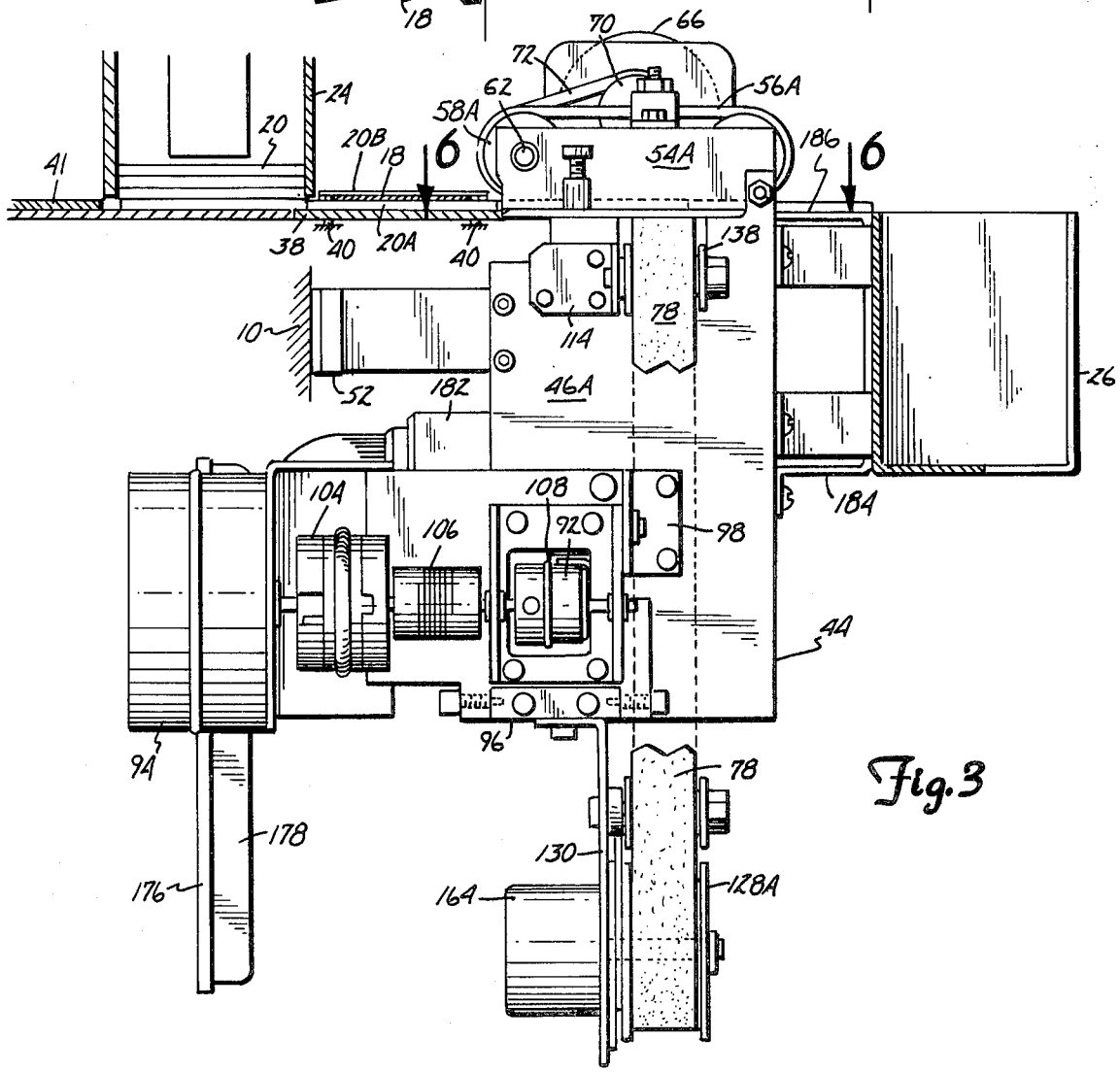
Fig. 3

APPARATUS FOR PRINTING ALPHANUMERIC INFORMATION ON PHOTOGRAPHIC SLIDE MOUNTS

CROSS-REFERENCE TO CO-PENDING APPLICATIONS

Cross reference is hereby made to the following applications which were filed on even date herewith and are assigned to the same assignee as this application: "Stored Setup Control System for Slide Mount Data Printer", D. Adams, G. Beckman and M. Schultz, Ser. No. 341,290, filed Jan. 21, 1982; "Slide Mount Data Printer with Count Status Indication", G. Beckman and M. Schultz, Ser. No. 341,466, filed Jan. 21, 1982; "Slide Mount Data Printer Control System with Diagnostic Tests", M. Schultz, Ser. No. 341,469, filed Jan. 21, 1982; "Slide Mount Data Printer", C. Euteneurer, Ser. No. 341,299, filed on Jan. 21, 1982; and "Slide Motion Sensor for Slide Mount Data Printer", R. Simning and M. Schultz, Ser. No. 341,297, filed on Jan. 21, 1982.

BACKGROUND OF THE INVENTION

1. Field of the Invention

The present invention relates to photographic slide mounting apparatus. In particular, the present invention relates to apparatus for printing alphanumeric information on photographic slide mounts after a photographic film transparency has been mounted in the slide mount frame.

2. Description of the Prior Art

Photographic slides are produced by mounting a photographic film transparency in a slide mount frame so that the image of the photographic transparency is aligned with the aperture of the frame. A variety of different types of slide mount frames and mounting apparatus have been developed.

One particularly advantageous type of photographic slide mount is the Pakon slide mount, which is a one-piece plastic slide mount sold by Pako Corporation, the assignee of the present application. The Pakon slide mount is a unitary, preclosed mount which requires no folding or sealing after the film is inserted into the mount. Instead, the Pakon slide mount has an insertion slot which may be resiliently expanded by forces applied to the mount by a slide mounting machine to permit insertion of film into a receiving pocket in the mount. After the film has been inserted and cut, the forces applied to the mount are removed, and the spring-like properties of the plastic slide mount allow the mount to return to its original condition, with the insertion slot closed. The slide mount, with the film transparency in the receiving pocket, is then ready for use in a conventional slide projector.

U.S. patents showing slide mounts and slide mounting apparatus of this general type include the following patents:

Florjancic et al, U.S. Pat. No. 3,341,960
Mundt et al, U.S. Pat. No. 3,470,642
Mundt et al, U.S. Pat. No. 3,478,456
Mundt et al, U.S. Pat. No. 3,524,299
Mundt et al, U.S. Pat. No. 3,562,074
Mundt, U.S. Pat. No. 3,570,342
Mundt et al, U.S. Pat. No. 3,614,854
Florjancic, U.S. Pat. No. 3,788,031
Mundt et al, U.S. Pat. No. 3,807,121
Mundt et al, U.S. Pat. No. 3,943,029

Mundt et al, U.S. Pat. No. 3,977,280
Urban, U.S. Pat. No. 4,004,340
Urban et al, U.S. Pat. No. 4,135,343

The slide mounting apparatus used for mounting transparencies in Pakon slide mounts typically includes a magazine which holds empty slide mounts, a slide track which extends forward from the magazine, and a film track which is perpendicular to the slide track and which intersects the slide track at a film insertion station. The mounting apparatus pushes a lowermost slide mount out of the magazine and into the slide track. The insertion opening of the slide mount faces the film track, so that when the slide mount is aligned at the film insertion station and the insertion opening is resiliently opened, the leading end of the film can be advanced along the slide track into the slide mount through the insertion opening. The film transparency is severed from the end of the film strip and is then inserted the remaining distance into the slide mount, so that the image of the transparency is aligned with the aperture of the slide mount. As the next slide mount is pushed from the magazine into the slide track, it pushes the preceding slide mount from the film insertion station along the slide track toward a collecting basket. As successive mounting cycles of the apparatus occur, the slide mounts are sequentially advanced out of the magazine, along the slide track, and finally to the collecting basket.

In many cases, it is desirable to imprint information on a photographic slide mount after the photographic film transparency has been mounted in the slide mount frame. Numbering imprinters have been developed for use with photographic slide mounting apparatus which imprints numbers sequentially on the slide mounts. The imprinted numbers can be used by the customer to sort the slide mounts into sequential order, since the numbers correspond to the time sequence of the individual frames of the film.

While simply numbering the slide mounts is advantageous, there has been an increasing desire for further information to be printed on the slide mount. This information, which is in alphanumeric form, may include, for example, the customer's name, the photofinisher's name, the name of the scene contained in the slide mount, or the date the slide mount was produced, together with a sequential slide number.

Automatic slide mounting apparatus which includes the capability of printing alphanumeric messages on slide mounts has also been developed. Examples of this type of equipment include equipment manufactured by Loersch Corp. and apparatus manufactured by Byers Photo Equipment Company. This equipment includes a slide track for the finished photographic slide (i.e. a slide mount with photographic film transparency mounted therein) which extends away from the station at which the film transparency is mounted. This slide track is generally horizontal and parallel to the film track along which the web of photographic film is advanced. As the finished slide mount is advanced away from the mounting station, it is moved past a stationary print head. Individual letters and numbers are imprinted on the slide mount as it is moved past the print head. The print head is a matrix of individual print elements which strike an ink ribbon to transfer ink onto the slide mount as the slide mount is advancing past the print head.

While the Loersch and Byers imprinters are usable in conjunction with the particular slide mounts and slide mounting apparatus manufactured by those companies, they are not usable with other types of slide mounting apparatus. In particular, there is a need for printing apparatus for use in conjunction with the Pakon slide mounts and slide mounting apparatus. This type of mounting apparatus differs from the other mounts and mounting apparatus in that the Pakon slide mount is preclosed, and is advanced along a slide track which is perpendicular to the film track. There is a continuing need for an improved printing apparatus for use in conjunction with photographic slide mounting apparatus which is reliable, which provides flexibility in the alphanumeric information to be printed, which is capable of high production rates, which is consistent and compatible with operation of Pakon slide mounter apparatus, and which does not significantly increase the size of the slide mounting apparatus in order to provide the printing functions.

SUMMARY OF THE INVENTION

The present invention is a data printing apparatus for printing alphanumeric information on photographic slide mounts. The apparatus includes a slide track along which photographic slide mounts are advanced and a carriage track which is aligned in a plane parallel to the plane of the slide track and in a generally transverse direction to the slide track. A print head is carried on a movable carriage for printing alphanumeric characters on a slide mount when the slide mount is positioned in the slide track at a printing station. The carriage is moved on the carriage track by carriage drive means. Control means control the print head and the carriage drive means to print selected alphanumeric information on the slide mount.

In a preferred embodiment of the present invention, the control means controls operation of the print head as a function of stored data representative of alphanumeric information to be printed on a slide mount and as a function of signal pulses which are representative of incremental motion of the carriage on the carriage track. The signal pulses are produced, for example, by a linear optical encoder and an optical sensor. The signal pulses are produced as relative movement of the linear optical encoder with respect to the optical sensor occurs to a result of movement of the carriage on the carriage track.

The apparatus of the present invention is preferably used in conjunction with a slide mounting apparatus in which the slide track has an entrance and an exit end and has a film insertion station between the entrance end and the printing station. Film inserting means cause a photographic film transparency to be at least partially inserted into the slide mount at the film insertion station. Mount indexing means causes slide mounts to be indexed from station-to-station along a slide track. The magazine for holding the stack of empty slide mounts is positioned adjacent the entrance end of the slide track, and a slide mount collecting means such as a collecting basket is positioned adjacent the exit means of the slide track for receiving the slide mounts as they leave the exit end.

BRIEF DESCRIPTION OF THE DRAWINGS

FIG. 1 is a perspective view showing a slide mounting system including the data printing apparatus of the present invention.

FIG. 2 is a top plan view of the slide mounting and data printing apparatus of FIG. 1, with top cover removed.

FIG. 3 is a side sectional view along section 3—3 of FIG. 2.

FIG. 4 is a front elevational view of the data printing apparataus of FIGS. 2 and 3.

DETAILED DESCRIPTION OF THE PREFERRED EMBODIMENTS

Figure 5:
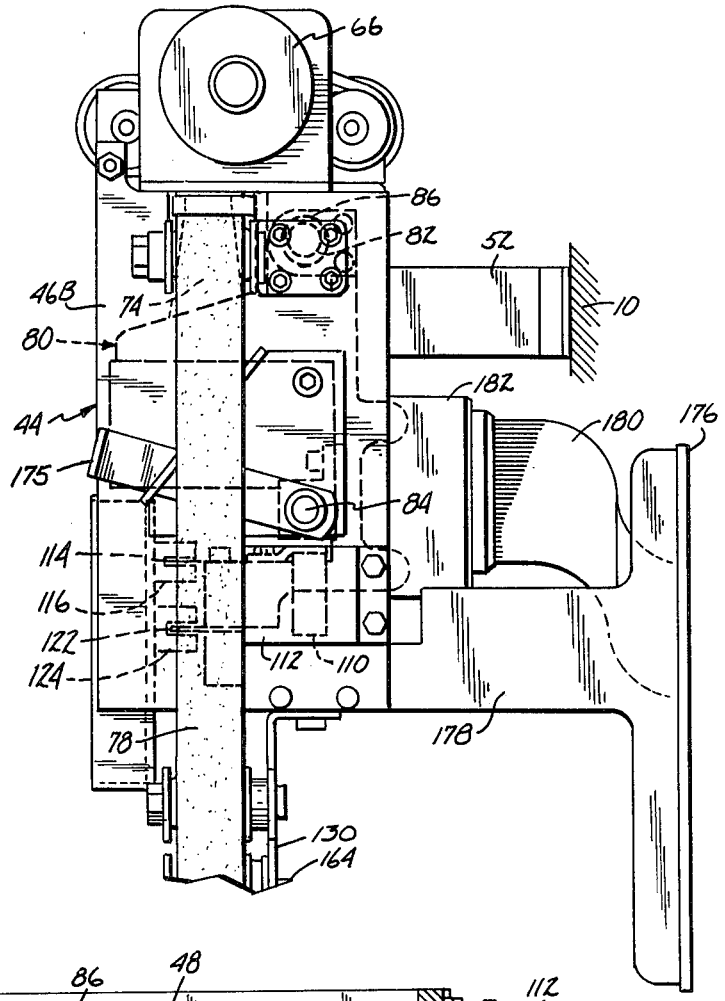
FIG. 5 is a right side elevational view of the data printing apparatus.
Figure 6:
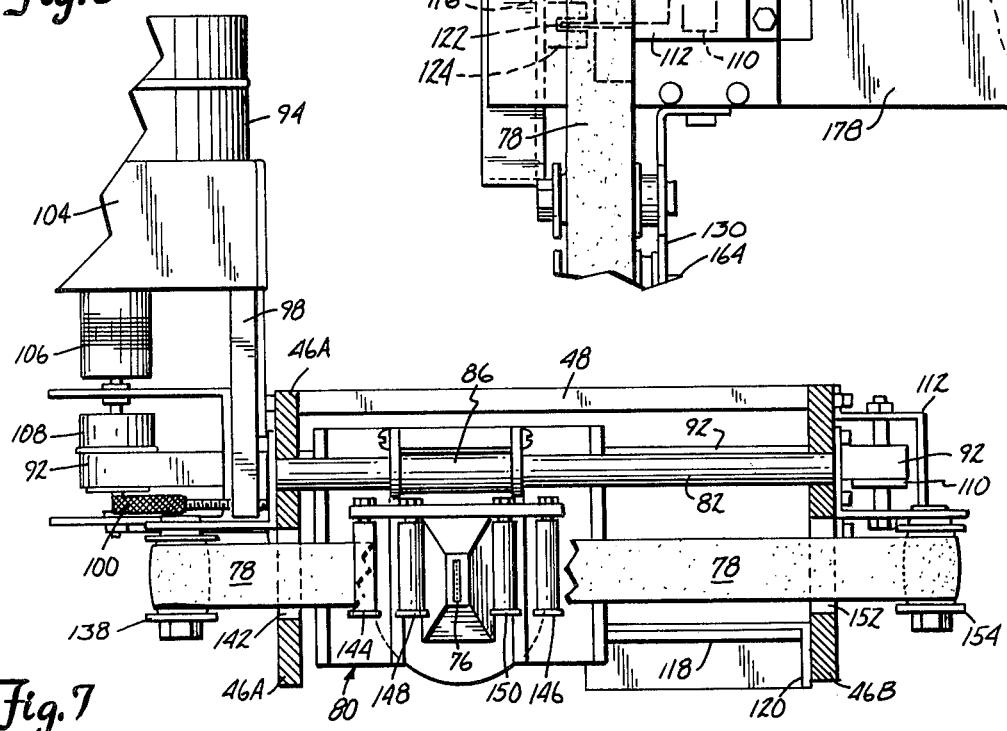
FIG. 6 is a sectional view along section 6—6 of FIG. 3 showing the print head.

1. The Slide Mounting and Data Printing System

FIG. 1 shows a photographic slide mounting system which incorporates the data printing apparatus of the present invention. The system shown in FIG. 1 includes slide mounter 10, data printer 12 and printer control console 14, all of which are supported on table 16. Mounter 10 which is, for example, a Pakon Model 509 mounter, automatically cuts and mounts individual film transparencies from the end of photographic film web 18 in preclosed plastic slide mounts 20, which are supported on arbor 22. During each operating cycle, the lower slide mount 20 in magazine 24 is pushed out of magazine 24 and into a generally horizontal slide track which extends between magazine 24 and collecting basket 26. Film web 18 is advanced along a film track which is generally horizontal and which is perpendicular to the slide track. Slide mount 20 is preferably a preclosed plastic slide mount such as the Pakon slide mount which has an insertion slot adjacent the edge which is closest to the film track. The intersection of the film track and the slide track defines a film insertion station, where the leading end of film web 18 is partially inserted through the insertion opening in slide mount 20. A knife (not shown) sewers the transparency from the remaining portion of web 18, the transparency is inserted the remainder of the distance into slide mount 20, and the forces which held the insertion opening open are then removed to allow the slide mount to close.

In the preferred embodiment shown in FIG. 1, data printer 12 is attached to the right front portion of slide mounter 10 between the film insertion stations and collecting basket 26. Data printer 12 extends the slide track to and two stations: a data printing station where alphanumeric information is printed on the bottom side of the slide mount 20, and a holding station where slide mount 20 is held after leaving the data printing station and before being deposited into collecting basket 26.

The alphanumeric information printed on slide mount 20 is based upon control signals which have been entered by the operator through keyboard 28 of control console 14 and which are stored in data memory by the control system of data printer apparatus 12. Keyboard 28 allows the operator to select not only the alphanumeric information to be printed, but also the particular operating made of data printer 12 which is to be used. Control console 14 also includes display 30, which allows the operator to view the alphanumeric information and to receive prompting messages from the control system.

2. Data Printer Mechanical System

FIGS. 2–7 show the mechanical system of data printer 12 (along with selected portions of slide mounter 10). In the embodiment illustrated in FIGS. 2–7, the partial insertion, cutting, final insertion of the film and the closing of the slide mount all occurs at a single film insertion station 32. In other slide mounters of this general type, the transparency is partially inserted and cut at the film insertion station, and is inserted the remaining distance into the slide mount frame as it is advanced away from the film insertion station. It will be understood, however, that the data printer of the present invention is usable with either type of slide mounter.

As illustrated in FIG. 2, guide rails 34 of slide mounter 10 define the film track along which film web 18 is advanced. The first portion of the slide track (which corresponds to film insertion station 32) is defined by guide rail 36 and base plate 38 of slide mounter 10.

As best shown in FIG. 5, slide mount 20 has a base 20A and a top cover 20B. A pair of pins 40 are moved upward through holes in base plate 38 and corresponding holes in base 20A to lift top cover 20B to create the insertion opening through which the end of film web 18 is inserted. After cutting and final insertion of the severed end of film web 18 into slide mount 20, pins 40 are retracted to allow cover 20B to return its original position, thus closing the insertion opening.

During the next operating cycle of mounter 10, another empty slide mount frame is pushed by slide pusher 41 out of magazine 24 and along the slide track to insertion station 32. The previous slide mount 20 which was located at film insertion station 32 is pushed by the leading edge of the succeeding mount into data printing station 42 of data printer 12. When slide mount 20 is positioned in printing station 42, alphanumeric characters are printed on the bottom side of base 20A of slide mount 20.

Data pinter 12 includes a generally rectangular frame as having a pair of vertical side plates 46A and 46B, cross brace 48, and slide track platform 50. Frame 44 is attached directly to slide mounter 10 by rigid mounting bracket 52, which is attached to side plates 46A and 46B.

Platform 50 is generally horizontal, is connected between the upper ends of side plates 46A and 46B, and is coplanar with and abuts base plate 38 of slide mounter 10. Platform 50 and guide blocks 54A and 54B define the extension of the slide track from film insertion station 32 through data printer 12 to collecting basket 26. Guide blocks 54A and 54B have overhanging edges which overhang and guide the longitudinal edges of slide mount 20 as they advance along the slide track through data printer 12.

Slide mount 20 is held securely at printing station 42 between platform 50 and a pair of conveyor belts 56A and 56B. Conveyor belts 56A and 56B are soft, flexible, compressible, high friction elastomeric belts. Belt 56A is trained over pulleys 58A and 60A, while belt 56B is trained over pulleys 58B and 60B. The lower runs of conveyor belts 56A and 56B are positioned parallel to the longitudinal direction of the slide track and engage the longitudinal side surfaces of top cover 20B of slide mount 20 as it is advanced out of film insertion station 32 and into printing station 42. Pulleys 58A and 58B are mounted on a common drive shaft 62 which is journalled through guide blocks 54A and 54B and has a pulley 64 at one end. Eject drive motor 66 has a drive shaft 68 which is connected through pulley 70 and drive belt 72 to pulley 64 and drive shaft 62. Pulleys 60A and 60B are idler pulleys which are rotatably mounted to guide blocks 54A and 54B, respectively. As will be discussed in further detail later, eject motor 66 is actuated at the end of a customer order to drive the slide mounts remaining in data printer 12 out of the slide track and into collecting basket 26. During the normal operating cycles of mounter 10 and data printer 12, eject motor 66 is not actuated, and conveyor belts 56A and 56B are drive solely by friction between the advancing slide mount 20 and belts 56A and 56B.

The second function of eject motor 66 is to detect the motion of slide mount 20 into data printer 12. As slide mount 20 enters data printer 12 from motion of slide pusher 41, and the following mount which is being pushed into film insertion station 32, it is wedged between the platform 50 and the conveyor belts 56A and 56B. The motion causes belts 56A and 56B to turn, which in turn drives DC eject motor 66 causing a DC voltage to be generated. This voltage inputs into the control system of data printer 12, and slide motion is thereby verified. This prevents data printer 12 from printing when no slide mount is present at printing station 42 or from double printing on one slide mount if a misfeed occurs in mounter 10.

The alphanumeric information is printed on the bottom side of base 20A of slide mount 20 by print head assembly 74, which is a ballistic impact head having a plurality of solenoid driven print wires 76 (shown in FIG. 6) which are individually actuated to impact ink ribbon 78. The impact of a print wire 76 with ink ribbon 78 transfers an ink dot onto the bottom surface of slide mount 20. Platform 50 of slide track 26 has an aperture which exposes the bottom surface of slide mount 20 to ink ribbon 78.

In the data printing apparatus 12 of the present invention, the characters being printed on slide mount 20 are oriented in a direction which is transverse to the direction of movement of slide mounts 20 along the slide track. In order to print a line of alphanumeric information without an impractically large print head mechanism, print head assembly 74 is mounted on movable carriage 80. In a preferred embodiment, print head assembly 74 is a ballistic impact head which has nine print pins or print wires 76 (shown in FIG. 6) which are individually driven by hammers (not shown). Each hammer impacts the lower end of one of the print wires 76 when its respective solenoid (not shown) is energized. There is one hammer and one solenoid for each print wire 76, and the hammers and solenoids are arranged in a circular pattern around the lower ends of the print wires.

Movable carriage 80 is movable on a carriage track defined by parallel horizontal shafts 82 and 84. Upper shaft 82 passes through linear bearing 86 (shown in FIGS. 5 and 6) which is attached to the upper end of carriage 80. Lower shaft 84 passes through linear bearings 88 and 90. Bearings 86, 88 and 90 provide support of carriage 80 with low drag during its movement on the carriage track defined by shafts 82 and 84.

Shafts 82 and 84 are supported by side plates 46A and 46B of frame 44. The carriage track defined by shaft 82 and 84 is horizontal, parallel to the plane of the slide track, perpendicular to the longitudinal direction of the slide track, and below the bottom surface of slide mount 20 when it is in printing station 42. Clamp 91 attaches carriage 80 to timing belt 92, which is driven by carriage drive motor 94. In the preferred embodiments shown in FIGS. 2–7, carriage drive motor 94 is a reversible AC synchronous motor which is pivotally mounted through side plate 46A by mounting plate 96 and brackets 98 and 102. A tension adjusting screw 100 is threaded through mounting plate 96 and bears against side plate 46A to adjust the tension on timing belt 92. Carriage drive motor 94 supplies drive to timing belt 92 through clutch assemblies 104 and 106 and pulley 108. The upper run of timing belt 92 is clamped to carriage 80 by clamp 91, so that any movement of timing belt 92 results in movement of carriage 80. The opposite end of timing belt 92 is trained over pulley 110, which is rotatably mounted by bracket 112. As best shown in FIGS. 4–7, bracket 112 is attached to side plate 46B.

Linear encoder 114 is attached to carriage 80 and passes through infrared encoder sensor assembly 116. Encoder pulses produced by encoder sensor assembly 116 signal the control circuitry of data printer 12 as to when printing should occur and where carriage 80 is with respect to the end of travel. When the end of travel has been reached, the motor direction is reversed for the next cycle of printing. Linear encoder 114 and encoder sensor assembly 116 ensure that printing on slide mount 20 is accurately spaced and eliminate variable character width due to speed fluxuations of carriage 80.

Figure 7:
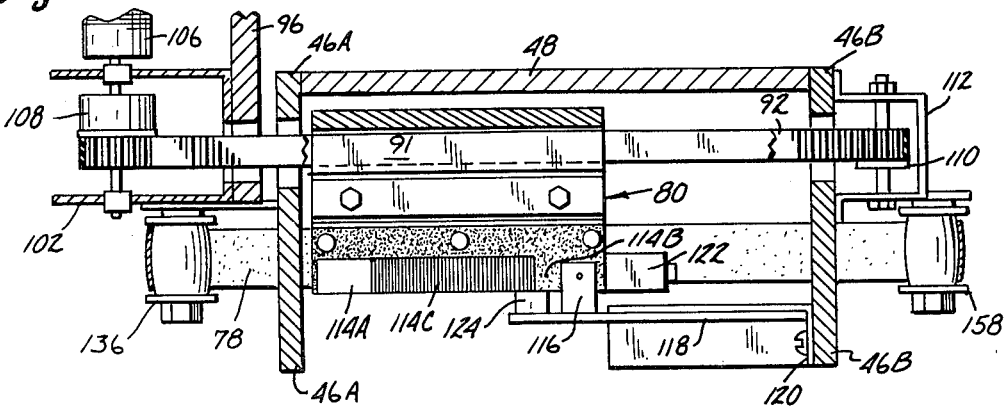
FIG. 7 is a sectional view along section 7—7 of FIG. 4 showing the linear encoder assemby.

As best shown in FIG. 7, linear encoder 114 is preferably a clear plastic sheet having a first end portion 114A which is transparent, a second end portion 114B which is opaque, and in intermediate portion 114C with a plurality of spaced parallel opaque lines. Encoder sensor assembly 116 is mounted on circuit board 118, which in turn is mounted to side plate 46B by mounting bracket 120. Thus sensor assembly 116 is in a fixed position with respect to carriage 80 and linear encoder 114 as carriage 80 is moved on the carriage track defined by shafts 82 and 84. Circuit board 118 carries electrical circuitry (not shown) to energize encoder sensor assembly 116 and to process the encoder pulses. Encoder sensor assembly 116 includes an infrared source such as a light-emitting diode on one side of linear encoder 114, and an infrared sensor such as a photodiode positioned on the opposite side of linear encoder 114. The opaque portions of linear encoder 114 block the infrared beam emitted by the infrared source from reaching the infrared sensor while the transparent portions of the linear encoder 114 permit the beam to reach the infrared sensor. The opaque parallel lines in intermediate portion 114C of linear encoder 114 represent increments of travel of carriage 80 with respect to encoder sensor assembly 116. As carriage 80 moves and the parallel opaque lines pass between the infrared source and infrared sensor of encoder sensor assembly 116, electrical encoder pulses representative of incremental travel of carriage 80 are produced. End portions 114A and 114B allow the control system of data printer 112 to determine whether carriage 80 is located at the left or right end of the carriage track.

In order to prevent damage to print head 74, aperture plate 122 and window sensor assembly 124 are provided. Aperture plate 122 is a metal plate which is mounted to the bottom end of carriage 80 and has an aperture which is shorter than intermediate section 114C of linear encoder 114 and is shorter than the printing opening in platform 50. The aperture defined by aperture plate 122 is used to define the limits between which pin 76 of print head 74 can be actuated. This provides a hardware safety feature which prevents actuation of print head 74 at a position where pin 76 could strike and be damaged by platform 50. Window sensor assembly 124 is mounted on circuit board 118 and is preferably an infrared source/infrared sensor assembly similar to encoder sensor assembly 116. As best illustrated in FIG. 4, the position of the "window" in aperture plate 122 is adjustable by means of adjusting screw 126.

Ribbon 78 extends between a pair of spools 128A and 128B which are rotatably mounted at the bottom of data printer 12 by mounting bracket 130. Ribbon 78 extends over guide 132, between guides 134, over guide roller 136 and upward to and over idler roller 138, which is mounted to side plate 46A by mounting bracket 140. Ribbon 78 then travels in a generally horizontal direction through aperture 142 in side plate 46A to carriage 80.

As best shown in FIG. 4, idler rollers 144 and 146 and guides 148 and 150 are mounted at the upper end of carriage 80 and move with carriage 80 as carriage 80 is driven along the carriage track. Ribbon 78 passes under idler roller 144, over guides 148 and 150 and then under idler roller 146. The portion of the path of ribbon 78 between guides 148 and 150 is horizontal and positioned between print pins 76 in the upper end of print head 74 and the bottom surface of slide mount 20.

The path of ribbon 78 from idler roller 146 is generally horizontal and passes through aperture 152 in side plate 46B. Ribbon 78 is trained over idler roller 154, which is rotatably mounted by mounting bracket 156 to the outer side of side wall 46B. Ribbon 78 travels downward from idler roller 154 to idler roller 158, between guides 160, over guide 162, and onto spool 128B.

The ribbon mechanism illustrated in FIGS. 2–7 provides automatic direction-of-wind reversal. Ribbon 78 is driven by ribbon drive motor 164 (which is preferably an AC gear motor) through reversible ratchet mechanism 166. Ribbon drive motor 164 is energized during printing cycles of data printer 12.

Positioned on the opposite side of slide mount 20 from ribbon 78 is platen 168, which is a flat metal plate. Slide mount 20 is held securely by guide blocks 54A and 54B, the lower runs of conveyor belts 56A and 56B, and by platen 168 when slide mount 20 is positioned at the printing station. Platen 168 is supported over the top surface of slide mount 20 by plate support bracket 170, which extends between the top surfaces of guide blocks 54A and 54B. Platen support bolts 172 and nuts 174 provide adjustability to the vertical position of platen 168. The purpose of platen 168 is to prevent slide mount 20 from deflecting when print wires 76 impact ribbon 78 against the lower surface of slide mount 20.

The density of print is adjusted by positioning density adjust lever 175 (FIG. 5) up or down. Density adjust lever 175 turns eccentric lower traverse shaft 84 such that carriage 80 and print head 74 moves up or down in respect to slide mount 20. By varying the distance between the print head 74 and the slide mount 20 various intensities of impact force from print wires 76 can be achieved.

The print head solenoid drive circuitry which provides drive signals to the individual solenoids of print head 74 is contained within console 14 and is connected to print head 74 through circuit board 176. As best shown in FIGS. 3 and 5, circuit board 176 is mounted to frame 44 by mounting bracket 178. Electrical connection between circuit board 176 and print head 74 is provided by a flexible flat electrical conductor 180, which has one end connected to circuit board 176 and its opposite end connected to electrical connector 182. Electrical connector 182 is mounted on and moves with carriage assembly 80, and thus provides electrical connection to print head 74.

Collecting basket 26 is mounted to frame 44 by mounting bracket 184. Platform extension 186 is coplanar with platform 50 and provides a continuation of the slide track from the printing station 42 to collecting basket 26. The portion of the slide track between printing station 42 and collecting basket 26 defines a slide mount holding station 188. After being pushed out of printing station 42 by the next slide mount to be printed, slide mount 20 is held at holding station 188. During the succeeding cycle, the mount which has just been printed is pushed to slide mount holding station 188, and the slide mount which had been at holding station 188 is pushed into collecting basket 26.

In operation, slide mounter 10 and data printer 12 require four operating cycles to advance slide mount 20 from magazine 24 to collecting basket 26. During the first cycle slide mount 20 is moved to film insertion station 32, where the leading end of film web 18 is inserted, cut and fully inserted into slide mount 20. During the second operating cycle, slide mount 20 is pushed between conveyor belts 56A and 56B and platform 50 into printing station 42. Conveyor belts 56A and 56B maintain the edges of slide mount 20 from loosing contact and overlapping when traveling through data printer 12. In addition, the movement of conveyor belts 56A and 56B due to the advancement of slide mount 20 to the printing station 42 provides motion which is transmitted back to eject drive motor 66. The rotation of drive shaft 68 of motor 66 causes eject motor 66 to act as a generator. The generated electrical signal produced by eject motor 66 is used as a slide detect signal to the control circuitry of data printer 12. The slide detect signal indicates that a slide mount 20 has been moved into position in printing station 42, and that operation of print head 74 can be initiated. During the second cycle of operation, and after slide mount 20 is stopped at printing station 42, carriage drive motor 94 drives carriage assembly 80 from one end of travel to the other, and the individual solenoids of print head 74 are actuated to produce the desired alphanumeric message on the bottom surface of slide mount 20. Control of print head 74 is based upon stored data which was previously entered by the operator through control console 14, and upon the encoder pulses produced by encoder sensor assembly 116. In preferred embodiments of the present invention, carriage 80 moves from left to right during one cycle, and from right to left during the following cycle. Print head 74 is controlled so that the proper message is printed regardless of which direction carriage 80 is moving during a particular cycle.

During the third operating cycle, slide mount 20 is pushed out of printing station 42 and into holding station 188. During the fourth operating cycle, slide mount 20 is pushed out of holding station 188 and into collecting basket 26.

At the end of each customer order (i.e. when the final slide mount of a customer order is positioned at printing station 42), the operator can signal data printer 12 that the order has been completed. Eject motor 66 is actuated to drive the remaining two slide mounts of the customer order, which are located at printing station 42 and holding station 188 into collecting basket 26. The operator can then remove the entire customer order on slide mounts from collecting basket 26. The first slide mount of the succeeding customer order is left in position at film insertion station 32.

3. Data Printer Electrical Control System

Figure 8:
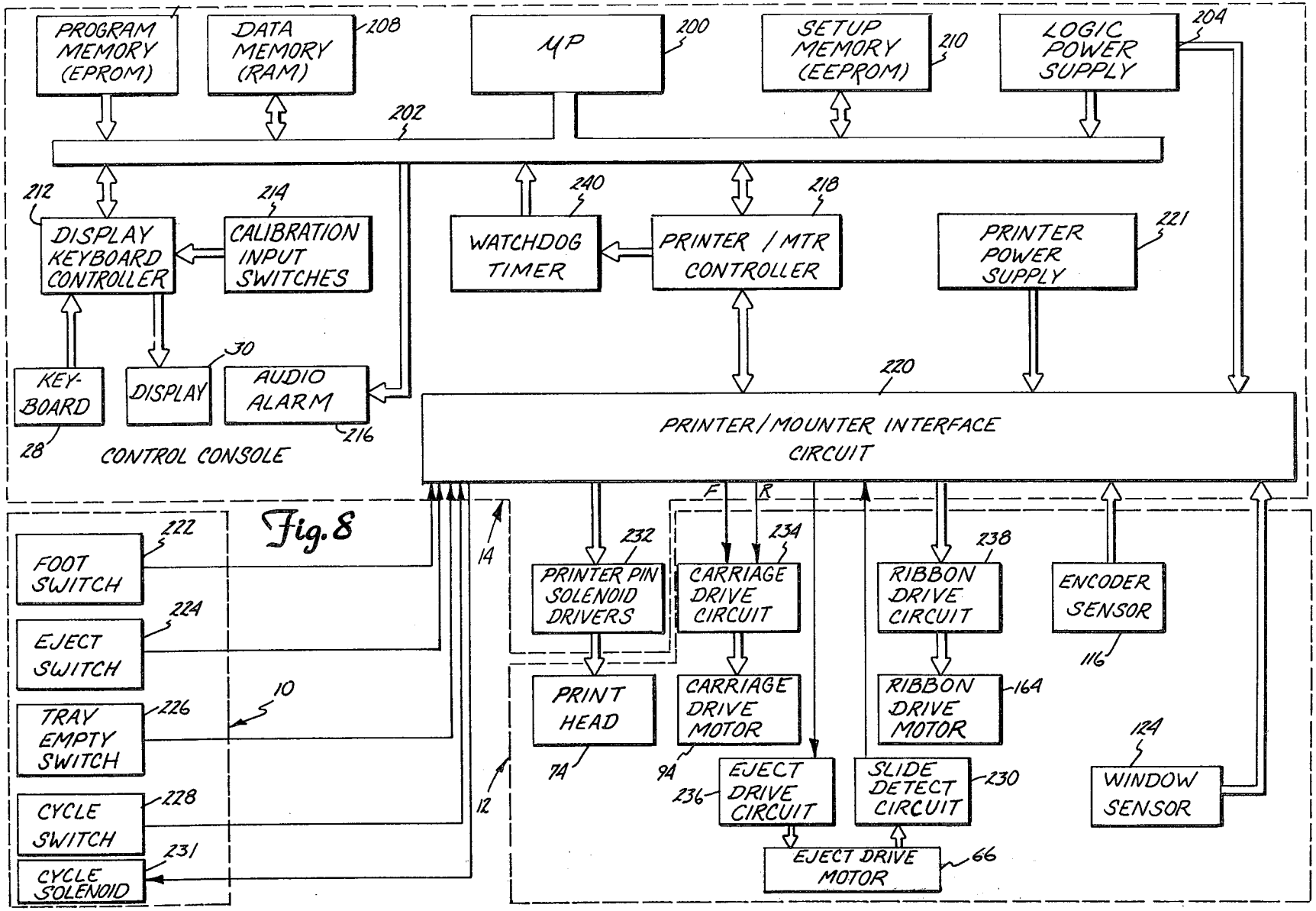
FIG. 8 is an electrical block diagram of the data printing apparatus of the present invention.

FIG. 8 is an electrical block diagram of the control system of the data printing apparatus of the present invention. The control system shown in FIG. 8 includes those assemblies required to drive and control printer 12, to receive inputs from keyboard 28 and provide control signals to display 30 of control console 14, and to receive and provide signals to those portions of slide mounter 10 required to coordinate operation of slide mounter 10 with data printer 12.

The operation of mounter 10, data printer 12, and control console 14 is primarily controlled by microprocessor 200, which is preferably an eight-bit microprocessor. Microprocessor 200 communicates with other portions of the control system through master bus 202, which includes an address bus, a data bus, control lines and power supply lines. Power is supplied to microprocessor 200 and other portions of the digital logic by a logic power supply 204.

Microprocessor 200 controls operation of the control system based upon a stored program contained in program memory 206, which is preferably an erasable programmable read only memory (EPROM). In one preferred embodiment, program memory 206 contains 8K bytes of memory storage. Program memory 206 cannot be altered by microprocessor 200 and is preserved when power is OFF.

Data memory 208 communicates with microprocessor 200 through master bus 202. In the preferred embodiment, data memory 208 contains 512 bytes of random access memory (RAM) provided in two pages. Data memory 208 contains a program stack, display buffers, scratch pad cells, and the current setup being used in controlling operation of print head 74. The data stored by data memory 208 is temporary and can be altered by microprocessor 200. Data memory 208 is erased when power is turned OFF.

Setup memory 210 is a nonvolatile memory which is used to save blocks of setup parameters even when power is OFF. In a preferred embodiment, setup memory 210 includes one or more electrically erasable programmable read only memory (EEPROM) chips. Each chip holds seventy-five blocks of data. Each block of data, which represents one "setup" includes a mode; a text; a low count (for all modes except text only mode); a high count; a duplicate count; and a checksum. The data in setup memory 210 is alterable by microprocessor 200. Setup memory 210 is read by microprocessor 200 just like the other memories 206 and 208.

Each byte of EEPROM setup memory 210 has a life expectancy of ten thousand writes. In order to increase the life of setup memory 210, a defective block of data is automatically written into an alternate block. There are nine such alternate blocks per memory chip. Microprocessor 200 makes a determination of whether the data has been properly written into setup memory 210, and if not then automatically makes the shift to an alternate block. This shift is transparent to the operator, who still addresses the particular setup by means of keyboard 28 using the same setup number.

Microprocessor 200 receives operator control inputs from keyboard 28 and supplies output signals to display 30 of control console 14 through display keyboard controller 212. In addition, calibration input switches 214 provide a binary number through display keyboard controller 212 to microprocessor 200. This binary number tells microprocessor 200 how many encoder pulses to skip before printing the first column in the left-to-right printing mode. This allows printing to be centered on slide mount 20, thus effectively calibrating linear encoder 114. A technician may change the binary number by manipulating calibration input switches 214. In a preferred embodiment, a range of binary numbers are provided which correspond to from 0 to 255 encoder pulses.

Audio alarm 216 is preferably located within control console 14. Microprocessor 200 actuates audio alarm 216 for a 100 msec duration by addressing audio alarm 216 through master bus 202.

Microprocessor 200 receives input signals from mounter 10 and data printer 12 and supplies output and control signals to mounter 10 and data printer 12 through printer/mounter controller 218 and printer/-mounter interface circuit 220. Printer power supply 221 supplies the necessary voltages for printer/mounter interface circuit 220, print head 74, and window sensor 124.

In FIG. 8, only those portions of slide mounter 10 which provide signals to interface circuit 220 or receive signals from interface circuit 220 are shown. Foot switch 222 and eject switch 224 are operator control switches associated with slide mounter 10. Foot switch 222 is depressed by the operator in order to commence and continue operation of slide mounter 10. When foot switch 222 is released, operation of slide mounter 10 is halted. Eject switch 224 is a pushbutton switch which, when actuated, results in eject drive motor 66 being actuated to drive the final two slide mounts out of the slide track and into collecting basket 26. Eject switch 224 performs the same function as the EJECT/RESET key on keyboard 28. In addition to causing eject drive motor 66 to operate, depressing eject switch 224 also causes microprocessor 200 to reset the count if printer 12 is being operated in a slide numbering mode.

Other inputs from slide mounter 10 to printer/-mounter interface circuit 220 include tray empty switch 226 and cycle switch 228. Tray empty switch 226 indicates that magazine 24 has run out of slide mounts. Cycle switch 228 provides a signal which indicates that mounter 10 has just completed a mounting cycle. This signal is used to coordinate operation of data printer 12 with slide mounter 10.

Inputs to interface circuit 220 from data printer 12 include encoder sensor 116, window sensor 124, and slide detect circuit 230. As shown in FIG. 8, slide detect circuit 230 is connected to eject drive motor 66, and produces a signal when eject drive motor 66 produces a voltage output. This occurs when a slide mount is being pushed out of film insertion station 32 and into printing station 42. In that case, eject drive motor 66 is being operated as a generator rather than a motor. The eject drive motor 66, therefore, performs a dual function in data printer 12.

The outputs of microprocessor 200 which are supplied through controller 218 and interface circuit 220 are supplied to cycle solenoid 231 of mounter 10, and to printer pin solenoid drivers 232, carriage drive circuit 234, eject drive circuit 236, and ribbon drive circuit 238 of data printer 12. The output to cycle solenoid 231 initiates an operating cycle of mounter 10.

Printer pin solenoid drivers 232 supply drive pulses to the solenoids (not shown) of print head 74 in order to actuate the individual print pins (print wires 76) of the nine-pin array of print head 74. Solenoid drivers 232 are activated by microprocessor 200 through interface circuit 220 for 340 microseconds, as timed by a software loop.

Carriage drive circuit 234 accepts either a forward (F) or a reverse (R) signal from interface circuit 220. When the forward signal is provided, carriage drive circuit 234 causes carriage drive motor 94 to drive carriage 80 from left to right. Similarly, when the reverse signal is received, carriage drive circuit 234 causes carriage drive motor 94 to drive carriage 80 from right to left.

A signal from interface circuit 220 to eject drive circuit 236 turns on eject drive motor 66. Similarly, a signal from interface circuit 220 to ribbon drive circuit 238 turns on ribbon drive motor 164.

As shown in FIG. 8, the control system also includes watchdog timer 240. Microprocessor 200 sets watchdog timer 240 by a signal supplied through printer/mounter controller 218. The output of watchdog timer 240 is a system reset which is supplied to master bus 202.

Figure 9:
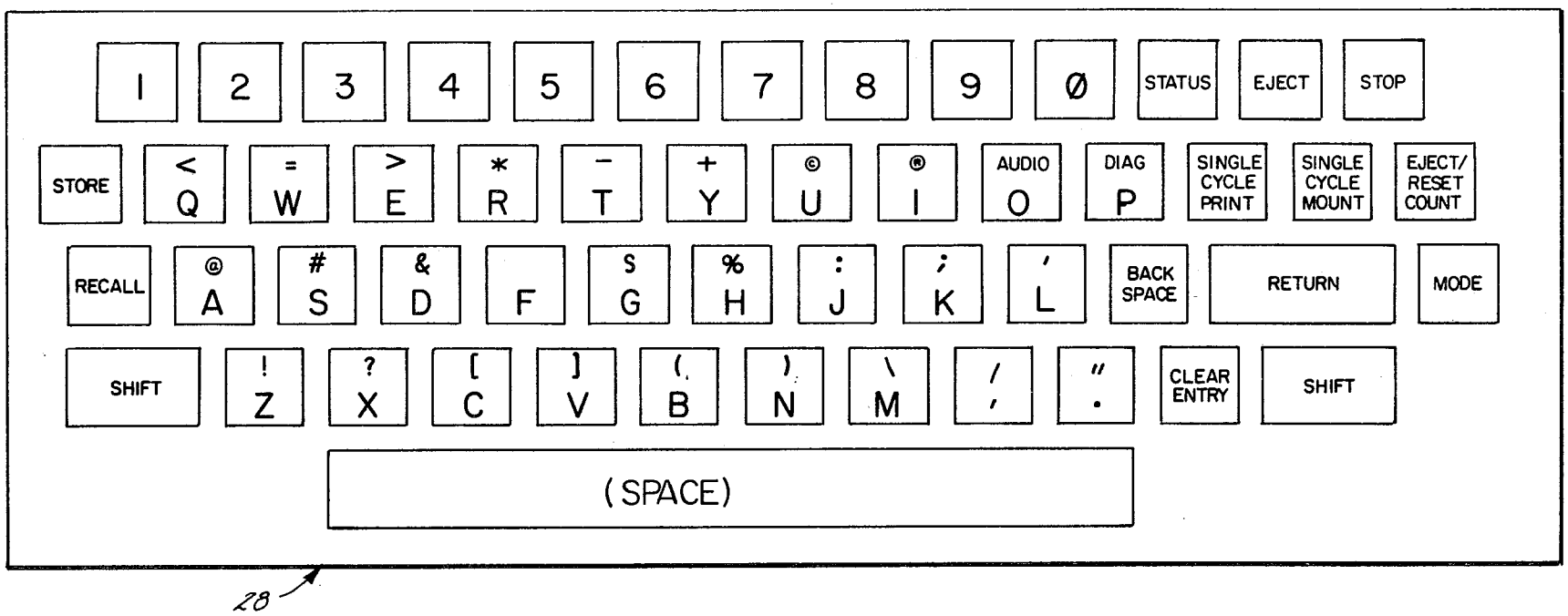
FIG. 9 is a plan view of the keyboard of the control console of the data printing apparatus of FIG. 1.

All operator controls of data printer 12 except foot switch 222 and eject switch 224 are contained on keyboard 28 of control console 14. FIG. 9 shows keyboard 28, which is preferably a 53-key membrane switch keyboard. Microprocessor 200 detects a key closure on keyboard 28 through display keyboard controller 212. As shown in FIG. 9, keyboard 28 includes both upper and lower case keys. Upper case keys must be preceeded by pressing of the SHIFT key.

4. Function of Operator Controls

There are three classes of operator controls: "activity controls" which cause activity of mounter 10 and data printer 12, "condition controls" which select operating conditions, and "data entry controls" which are used in data entry.

A. Activity Controls

The activity controls include foot switch 222, eject switch 224 and the STOP, SINGLE CYCLE PRINT, SINGLE CYCLE MOUNT, EJECT, and EJECT/RESET COUNT keys of keyboard 28.

Depressing foot switch 222 begins slide mounting and printing activities of mounter 10 and data printer 12. This allows mounter 10 and data printer 12 to operate automatically through a series of mounting and printing cycles until the STOP key is pressed, an error occurs (as sensed by the control circuitry), the terminal or final count has been reached in a slide numbering sequence, or foot switch 222 is released.

The STOP key stops the automatic mounting and printing operation of mounter 10 and data printer 12 at the end of the current cycle. The STOP key is also used to stop a diagnostic test when the control system is in a diagnostic mode.

The SINGLE CYCLE PRINT key allows the mounting and printing of one slide. Activation of this key allows the operator to examine a single mount before initiating fully automatic operation of mounter 10 and data printer 12.

The SINGLE CYCLE MOUNT key allows slide mounter 10 to advance one mount. No printing occurs, but film will be monted in the single slide mount.

The EJECT key causes microprocessor 200 to actuate eject drive motor 66. The last two mounts in the slide track are driven out of data printer 12 and into collecting basket 26.

The EJECT/RESET COUNT key on keyboard 28 and the eject switch 224 on slide mounter 10 perform the same function. Actuating either eject switch 224 or the EJECT/RESET COUNT key not only results in eject motor 66 being actuated, but also causes microprocessor 200 to reset the slide and duplicate counts. This is normally done at the end of each order.

B. Condition Controls

The condition controls include the AUDIO key, the MODE key, the STATUS key, the "+" key, the "−" key and the diagnostic (DIAG) key on keyboard 28. The AUDIO key is used to disable audio alarm 216. Normally audio alarm 216 sounds whenever any key of keyboard 28 is pressed. Audio alarm 216 will alternate between ON or OFF with repeated actuation of the AUDIO key.

When the MODE key is pressed, the currently selected operating mode of data printer 12 is displayed. Thus any operating mode may be selected by repeatedly pressing the MODE key until the desired mode is displayed. In a preferred embodiment of the present invention, the following six modes of operation are among those stored in program memory 206: Mode 1—Text Only; Mode 2—Count Up; Mode 3—Count Down; Mode 4—Count Up Duplicate; Mode 5—Count Down Duplicate; Mode 6—Incremental Text.

Pressing the STATUS key changes the information being displayed by display 30 during automatic operation of mounter 10 and data printer 12. Normally, microprocessor 200 controls display 30 to show exactly what will be printed on the slide mount at printing station 42. If a count field is being printed as part of the message (i.e. the slide mounts are being numbered), the count field changes appropriately with each mount, depending upon whether Mode 2, 3, 4 or 5 is in operation. For example, a typical message in count field may be: "ABC PHOTO 327". If the operator desires further information, this information will be displayed by display 30 in response to pressing of the STATUS key. For example, the depressing STATUS key will cause display 30 to display the following type of message: "SLIDE 327 OF 4400". In this additional message, the present mount number is "327" and the maximum count which has been preset by the operator is "4400". If a duplicate count mode was selected (i.e. modes 4 or 5), the STATUS key may be pressed again to obtain the following information on display 30: "DUPLICATE 1234 OF "2000". In this displayed message, the present duplicate count is "1234", and the maximum duplicate counts which was preset by the operator is "2000". Depressing the STATUS key again returns display 30 to its normal display operation. During any one of the operating modes selectable by the MODE key, microprocessor 200 will recognize only the STATUS and STOP keys when they are depressed by the operator. Any other key will be considered an invalid entry by microprocessor 200, and will be ignored.

The "+" key increments the slide and/or duplicate count without mounting or printing a slide. Similarly, the "−" key decrements the slide and/or duplicate count without mounting or printing a slide.

The DIAG key is used to select one of several diagnostic tests which microprocessor 200 will perform in order to check the functions of various components and subsystems of the data printing apparatus. Each time the DIAG key is depressed, the name of the next test in a list of tests stored in program memory 206 is displayed. The displayed test is begun by pressing the RETURN key and is stopped by pressing the STOP key. In a preferred embodiment of the present invention, program memory 206 stores instructions for the following diagnostic tests: display test; keyboard test; printer test; and encoder test; memory/input port test. The operation of each of these diagnostic tests will be described subsequently in further detail.

C. Data Entry Controls

The data entry controls includes the SHIFT key, the CLEAR ENTRY key, the BACK SPACE key, the RETURN key, the STORE key, the RECALL key, and the alphanumeric and punctuation keys of keyboard 28.

The SHIFT key is used to indicate to microprocessor 200 that a secondary function is being selected on the next key depression. The SHIFT key need not be held down as it is in a normal typewriter, and it does not lock. The secondary functions are the upper case symbols contained on the alphabetical and punctuation keys of keyboard 28.

The CLEAR ENTRY key signals microprocessor 200 to clear the text or count field. The CLEAR ENTRY key is used by the operator when setting up a printing format to be used by microprocessor 200 in controlling printer pin solenoid drivers 232. A single key stroke of the CLEAR ENTRY key clears out the entire text or count field.

The BACK SPACE key deletes the last character entered in the text field. It also backs up a movable cursor which appears on display 30 to indicate where the next character will be written on display 30.

The RETURN key signals to microprocessor 200 that the operator has completed the text or count field entered and allows microprocessor 200 to continue to the next sequential step in setting up the printing format. Depressing the RETURN key also begins a selected diagnostic test or a selected mode setup sequence.

The STORE key is used to store setup information into setup memory 210. Pressing of the STORE key must be followed by pressing an identifying setup number from "1" to "150". The STORE key may only be used at the end of the mode setup procedure.

The RECALL key is used by the operator to recall previously stored setup information from setup memory 210. This stored setup information includes the mode, text, and all count data being used. After pressing the RECALL key, the operator must key in the identifying setup number ("1" to "150") followed by depressing the RETURN key. Microprocessor 200 then causes display 30 to show the status for the requested setup.

It is also possible to scroll through the contents of setup memory 210 by pressing the RETURN key again after performing the RECALL sequence described above. Microprocessor 200 causes display 30 to then show: "ENTER RECALL NUMBER XXX" where XXX is the previous setup number plus 1. After a short pause, display 30 then shows the status for the next setup. This procedure may be repeated until the last setup is recalled.

There are sixty-four alphanumeric and punctuation characters selectable through keyboard 28. These characters conform to the standard ASCII set with the exception of the copyright symbol and the registered trademark symbol. The following table illustrates an example of the method of entering numeric data in keyboard 28 in response to PROMPT messages which are displayed on display 30:

| KEY PRESSED | DISPLAY 30 READS |
|---|---|
| RECALL | ENTER RECALL NUMBER |
| 1 | ENTER RECALL NUMBER 1 |
| 8 | ENTER RECALL NUMBER 18 |
| 6 | ENTER SETUP #1 to 150 (186 is too large) |
| 1 | ENTER RECALL NUMBER 1 |
| 2 | ENTER RECALL NUMBER 12 |
| Q | ENTRY ERROR (alpha not allowed) |
| CLEAR ENTRY | ENTER RECALL NUMBER |
| 1 | ENTER RECALL NUMBER 1 |
| 2 | ENTER RECALL NUMBER 12 |
| 6 | ENTER RECALL NUMBER 126 |
| RETURN | (status for setup 126) |

5. Externally Visible Data

The data produced by the control system which is visible to the operator consists of the printed data on the individual slide mount 20 and the data which is displayed on display 30. In the case of both the printed data and the displayed data, microprocessor 200 controls this data based upon the stored program in program memory 206, data stored in data memory 208, stored setups in setup memory 210, and input signals received from display keyboard controller 212 and from printer/mounter controller 218.

In a preferred embodiment of the present invention, data printer 12 prints up to 18 characters in a single line on slide mount 20. Printing is bidirectional: that is, printer carriage 80 moves from left-to-right for printing one mount, and from right-to-left for printing the next mount. This allows mounter 10 to operate at full speed without delays due to the operating speed of data printer 12. Any of the sixty-four alphanumeric and punctuation characters shown on keyboard 28 can be printed by print head 74 under the control of microprocessor 200. If a counting mode (i.e. modes 2–5) is selected, a one to four digit count field is printed at the right end of the line of characters. The count field is right-justified and is preceded by a space. In other words, at least one space separates the count field from the remaining portion of the message printed on slide mount 20.

In a preferred embodiment of the present invention, display 30 is a twenty-four character, single line, alphanumeric light-emitting diode (LED) display with a movable cursor. Under normal operation of mounter 10 and data printer 12, display 30 shows exactly the alphanumeric information that is to be printed on the next slide mount. Alternate information displays are selectable by the use of the STATUS key, as has been described above.

After power is first turned ON, and after microprocessor 200 has successfully executed its power up self test diagnostics, microprocessor 200 causes display 30 to show "READY-SELECT A MODE" as a prompting message. The operator is then allowed to select a mode and enter the required setup data through keyboard 28. Alternatively, the operator may press the RECALL key followed by a setup number and then press a RETURN key. This will recall all setup data for the particular setup number from setup memory 210, and microprocessor 200 loads the recalled setup into data memory 208 for use in controlling data printer 12. Upon completion of a mode setup or a recall, display 30 reverts to the normal status.

A movable visual cursor is provided by display 30 while the operator is entering text data. This cursor is a period which occupies the next available character position on display 30. The cursor will disappear when the end of the text field is reached or when the RETURN key is pressed upon completion of text entry.

In addition to the normal display, and the PROMPT messages used in mode setup or recall, display 30 also displays numerous error messages under the control of microprocessor 200. These error messages may be displayed after power up or during normal operation.

6. Modes of Operation

In a preferred embodiment of the present invention, there are six modes of operation. Before describing these modes, a brief description of the operating procedure of the data printing apparatus is appropriate.

On the back side of control console 14 is a power switch (not shown) which controls AC power to the apparatus. Microprocessor 200 first performs certain power up self tests which are among the diagnostic functions described later in this specification. If the self test fails, an error message is displayed on display 30 and microprocessor 200 halts further operations of the apparatus.

If the self tests are successful, "READY-SELECT A MODE" is then displayed on display 30. If the MODE key is pressed, the operator then follows the mode setup procedure in which the mode, text, and count information are entered through keyboard 28 and are stored by microprocessor 200 into data memory 208. Alternatively, the RECALL key may be pressed to obtain previously stored setup data from setup memory 210 and to store the selected setup data in data memory 208.

Display 30 will then show the normal status (i.e. exactly what will be printed on the next slide mount), based upon the stored data in data memory 208. In addition, display 30 will also show the message "-READY". Microprocessor 200 is now waiting for an activity control to be actuated. At this point, microprocessor 200 will only respond to actuation of foot switch 222, or to one of the following keys: SINGLE CYCLE MOUNT; SINGLE CYCLE PRINT; EJECT/RESET COUNT; CLEAR ENTRY; DIAG; EJECT; AUDIO; MODE; STATUS; +; −; or RECALL.

If foot switch 222 is depressed, automatic operation of slide mounter and data printer 12 is commenced. This automatic operation will continue until foot switch 222 is released, the STOP key is pressed, the final count contained in the setup data within data memory 208 is reached, or an error is detected. In any of these events, microprocessor 200 returns to the waiting stage described above. While automatic operation is occurring, microprocessor 200 will only respond to the STATUS key or the STOP key; or to foot switch 222.

A. Text Only Mode

The text only mode allows eighteen characters of alphanumeric data to be printed. The text may consist of all blanks. The name of the photofinisher, the date, or a descriptive phrase describing the scene contained in the slide are typical examples of data which can be printed in the text only mode.

No count field is printed in the text only mode. The mount number may be monitored, however, by pressing the STATUS key. When this occurs, microprocessor 200 causes display 30 to show a message which includes the present mount number and the maximum count.

In the text only mode, a maximum count may be entered, or it may be left at a default value of 9999. After the text only mode is selected, automatic operation is initiated by depressing foot switch 222. Slides will be mounted and printed automatically by slide mounter 10 in data printer 12, until an error occurs, or the maximum count is reached, or foot switch 222 is released.

B. Count Up and Count Down Modes

These two modes allow for a thirteen to sixteen character text field and a one to four digit count field to be printed. The count field may contain any number from "1" to "9999". Printing may begin and end at any selected numbers in this range. To allow for film orientation (i.e. first frame first vs. last frame first advancement of film web 18), up or down counting may be selected. For example, the count up mode may be selected with the count starting at "1" and ending at "36". The count field is reset to the beginning number when the EJECT/RESET COUNT key is pressed in preparation for the next order. Operation of the mounter 10 and data printer 12 in these two modes is similar to the text only mode.

C. Count Up and Count Down Duplicate Modes

These two modes allow up to 9999 slides to be printed before the count being printed in the count field changes. In all other respects, these two modes are similar to the count up and count down modes.

D. Incremental Text Mode

This mode allows a sequence of slide mounts to be printed with a sequence of text messages. Each text message is stored in a single setup within setup memory 210. When the incremental text mode is selected, microprocessor 200 advances from a designated initial setup number to a designated final setup number. With each mounting/printing cycle, microprocessor 200 advances to the next setup in the sequence stored within setup memory 210.

This mode of operation is advantageous for example, in an audio visual laboratory where many sets of the same slide show are being produced. With the incremental text mode, each slide of the slide show may bear a discrete different title and number. For example, slide No. 1 may say "Grand Canyon", No. 2 might say "Mount Rushmore", etc.

7. Mode Setup Procedure

The text and count information in data memory 208 for the selected mode may be viewed or changed by the following procedure:

(1) The MODE key is pressed until the desired mode is displayed.

(2) The RETURN key is pressed. (Steps (4) and (5) of this procedure are skipped for text only mode and incremental text mode).

(3) Display 30 will now read "HIGHEST COUNT=XXX", where XXX is the previously selected count. The high count is the ending count for a count up mode, or the beginning count for a count down mode. The RETURN key is pressed to preserve this displayed count. If a new count is desired, it is entered by means of the numerical keys on keyboard 28, and the RETURN key is then pressed.

(4) Display 30 now reads "LOWEST COUNT=XXX". A new count is entered by numerical keys on keyboard 28, if desired. To preserve the count, or after entering a new count, the RETURN key is pressed.

(5) Display 30 reads "DUPLICATE COUNT=XXX". A new duplicate count is entered, if desired, by use of the numerical keys on keyboard 28. The RETURN key is then pressed. (If a duplicate mode was not selected, this step is skipped).

(6) Display 30 now shows the text. New text may be entered through keyboard 28 or the displayed text may be retained. Once the desired text is being displayed, the RETURN key is pressed.

All of the information derived from Step (1) through Step (6) is stored in data memory 208 as the active setup, and may also be stored for future use in setup memory 210. To do this, the operator presses the STORE key instead of th RETURN key at the end of Step (6). The operator then enters the number of the desired storage location (1 to 150), and presses the RETURN key. This causes microprocessor 200 to store the information in the specified storage location within setup memory 210.

If a count mode was selected, the size of the text field is automatically limited by microprocessor 200 to allow room for the count field. In other words, the size of the text field is a function of the number of characters required for the count field. For example, if the highest count selected is "99", the count field requires two characters, and the space between the count field and the text field requires one character. Microprocessor 200 then allows the text field to occupy the remaining fifteen characters of the eighteen character total message field. If, on the other hand, the highest count is "9999", four characters are required for the count field and one character is required for the space between the count field and the text field. In this case, microprocessor 200 allows the text field to have a total of thirteen characters. This variable length text field provides greater flexibility in the size of the text field, since the size of the count field may only be made as large as necessary, and the remaining characters can be used for the text field (except for the space between the text and count fields).

It is also possible to change the text field without following the entire mode setup procedure outlined above in Steps (1) through (6). This is done by pressing the CLEAR ENTRY key. The operator then enters the new text through keyboard 28, and then presses the RETURN key. Microprocessor 200 makes the required changes to the next field stored in data memory 208, without changing the remaining count information.

After power is initially turned on, the previous values of the count stored in data memory 208 for the particular count information then active, is set to the following default values: highest count=999; lowest count=1; duplicate count=1.

When the incremental text mode is selected by use of the MODE key and then the RETURN key, microprocessor 200 then causes display 30 to display a PROMPT message "FIRST LOCATION=XXX". The operator then enters the number of the first storage location of the sequence of locations used in the incremental text mode. The operator then presses the RETURN key, which causes microprocessor 200 to store the first location in data memory 208.

Next, microprocessor 200 causes display 30 to display a PROMPT message "LAST LOCATION=XXX". The operator enters the number of the last desired storage location of the sequence and then presses the RETURN key, which causes microprocessor 200 to store the last location in data memory 208. The incremental text mode is then ready for operation upon actuation of foot switch 222. In operation, microprocessor 200 sequentially loads a new setup from setup memory 210 into data memory 208 for each printing cycle, beginning with the first location and continuing until the last location has been loaded into data memory 208 and a slide mount has been printed using the last setup.

8. Diagnostic Functions

The diagnostic functions performed by the control system under the control of microprocessor 200 are divided into three groups. The first group are power-up self tests, in which microprocessor 200 performs initial tests on data memory 208, program memory 206, display keyboard controller 212, printer/mounter controller 218, carriage drive circuit 234, and encoder sensor 116. The second group of diagnostic tests are operating diagnostics, which monitor and ensure normal automatic operation of slide mounter 10 and data printer 12. The third group of tests are service diagnostics, which are used by a service technician to verify proper operation of various subsystems of the data printing apparatus.

A. Power-Up Self Tests

After power is initially turned on, microprocessor 200 performs a sequence of diagnostic self tests. The first self test involves data memory 208. Microprocessor 200 fills each location of data memory 208 with the value "55H" and then with the value "AAH" to ensure that every bit line responds. Next, microprocessor 200 fills each byte of data memory 208 with the lower eight bits of its address to ensure that every address line responds. If an error occurs during these tests, microprocessor 200 causes display 30 to display an error message "RAM MEMORY ERROR". If an error is detected, only service diagnostics can be run, with the exception of the printer diagnostic.

After data memory 208 has been successfully tested, microprocessor 200 tests program memory 206. This is done by computing a check sum for each memory chip within program memory 206 and comparing it with the check sum that was stored on that memory chip during manufacture. This ensures that the program and the fixed data stored in program memory 206 are intact. If an error is detected, microprocessor 200 causes display 30 to display an error message: "EPROM MEMORY ERROR".

Next, microprocessor 200 tests input/output (I/O) status in order to provide some confidence in the integrity of the input and output ports contained in display keyboard controller 212 and printer/mounter controller 218. This is done by checking the status of the peripheral interfaces and keyboard/display chips within controllers 212 and 218. The input ports are also read to determine if they present sensible data. If an error is detected, microprocessor 200 causes diaplay 30 to display an error message: "I/O ERROR".

Finally, microprocessor 200 provides control signals to carriage drive circuit 234 which cause printer carriage 80 to be moved to the right and then to the left. During this motion, microprocessor 200 monitors the encoder pulses received from encoder sensor 216. If the prescribed number of encoder pulses are not detected, this indicates that there is an error in either operation of carriage drive motor 94, encoder sensor 216, or carriage drive circuit 234. Microprocessor 200 then causes display 30 to display an error message "PRINTER MOTION ERROR".

If all of the power-up self tests are performed successfully, microprocessor 200 is then ready to accept commands from the operator through keyboard 28.

B. Operating Diagnostics

The operating diagnostics monitor system operation during normal operation of mounter 10 and data printer 12. If any abnormalities are detected by means of input signal supplied to microprocessor 200, one of several error messages is displayed on display 30, and microprocessor 200 halts operation of mounter 10 and data printer 12 to wait for the error to be corrected.

The OUT OF MOUNTS error message indicates that magazine 24 is empty. After reloading magazine 24 with empty slide mounts, the operator may press foot switch 222 to continue operation where it left off. Microprocessor 200 detects this error by sensing the state of tray empty switch 226 before each mounting cycle in which cycle solenoid 231 is actuated.

The NO DATA STORED error message relates to setup memory 210. This message will be displayed on display 30 if the RECALL key is pressed for a setup number in which data was never stored in setup memory 210. Microprocessor 200 detects this error condition by testing the check sums stored with each setup within setup memory 210.

The MOUNTER MOTION ERROR message indicates that mounter 10 has been turned off or is jammed. After correcting the problem, the operator may resume operation by pressing foot switch 222. This error is detected by microprocessor 200 if cycle switch 228 has not closed and opened within a prescribed time after a mounter cycle is initiated by actuation of cycle solenoid 231, of if slide motion is not detected within a prescribed time. This latter error condition is detected by slide detect circuit 230, which monitors the output voltage of DC eject drive motor 66. Microprocessor 200 monitors the output of slide detect circuit 230 before initiating each cycle of data printer 12. The most likely cause for this error is a jam in slide mounter 10, which prevents a slide mount from advancing under conveyor belts 56A and 56B into data printer 12.

The MEMORY NOT INSTALLED message occurs if the STORE or RECALL keys are pressed when setup memory 210 is not installed.

The DEFECTIVE MEMORY message occurs if storing of setup data was not completed properly.

The PRINTER MOTION ERROR message indicates that encoder sensor 116 did not detect proper motion of carriage 80. This may be due to jamming of carriage 80 or faulty operation of encoder sensor 116. This error is detected if encoder pulses are not received within a prescribed time after carriage drive motor 94 has been actuated. This error may also be detected by microprocessor 200 if not all encoder pulses are detected during motion of carriage 80.

The ENTRY ERROR message indicates that an improper key of keyboard 28 was pressed in response to a prompt message displayed on display 30. It will occur, for example, if a alphabetic key is pressed where numeric data is expected, or if an out of range number is entered through keyboard 28. To recover, the operator must press the CLEAR ENTRY key. Microprocessor 200 will then cause the prompt message to be repeated.

The POWER FAILURE 24 V and the POWER FAILURE 12 V messages indicate that the 24-volt or 12-volt power supply is out of range. These errors are detected by interrupts to microprocessor 200 and can occur at any time. The error can only be cleared by turning off AC power to the system and correcting the problem.

The COUNT LIMIT REACHED message indicates that the maximum (or minimum for count down mode) count was reached on the last slide mounted. This is not an error, but rather a warning to the operator that the customer's order has been completed. Before microprocessor 200 will allow further operation of mounter 10 and data printer 12, either the slide count must be reset by use of the EJECT/RESET COUNT key (or eject switch 224) or the operator must change the count limits by means of keyboard 28.

C. Service Diagnostics

The control system of FIG. 8 also provides five service diagnostics which assist a service technician in verifying that selected portions of the control system are operating properly. This five service diagnostics are DISPLAY test, KEYBOARD test, PRINTER test, ENCODER test, and MEMORY/INPUT PORT test. Each of these tests is initiated by the operator or service technician by pressing the DIAGkey until the desired test is displayed on display 30, and then pressing the RETURN key. The test is halted by pressing the STOP key.

When the DISPLAY test is selected, microprocessor 200 causes all sixty-four characters which are displayable on display 30 to scroll across display 30 from right to left. Next, microprocessor 200 fills display 30 with each of the sixty-four characters in turn. This allows the service technician to observe each individual character of display 30 to verify that display 30 is operating properly. The DISPLAY test sequence will be repeated by microprocessor 200 until the STOP key is pressed.

When the KEYBOARD test is selected, microprocessor 200 causes display 30 to display the character or name of each key of keyboard 28 as it is pressed. The displayed character or name will be identical to the legend on the key that was pressed. None of the keys on keyboard 28 perform their normal function during this test, except for the STOP key.

When the PRINTER test is selected, microprocessor 200 causes data printer 12 to print a special test pattern on the slide mounts. In a preferred embodiment, this special pattern is a symmetrical pattern using all eighteen normal character spaces on the slide mount. The pattern is such that every print wire 76 is energized in every possible position used in forming characters. One such pattern uses characters having nine columns and nine rows. The first character printed on the slide has the top four rows printed in columns 2, 4, 6, and 8 and the bottom five rows printed in columns 1, 3, 5, 7, and 9. In the second character, the top five rows are printed in columns 1, 3, 5, 7, and 9 and the bottom four rows are printed in columns 2, 4, 6, and 8. These two charactes are alternated through the remaining sixteen character spaces printed on the mount. This test pattern provides a quick way of checking performance and alignment of print head 74. Printing and mounting proceed as in the normal automatic mode of operation during the PRINTER test, except that display 30 shows all exclamation marks (e.g., "!!!!!!!!!!!!").

When the ENCODER test is selected, microprocessor 200 provies control signals to carriage drive circuit 234 which cycles carriage 80 back and forth. During the cycling of carriage 80, microprocessor 200 counts encoder pulses from encoder sensor 116. No printing or mounting is initiated during the encoder test. Microprocessor 200 causes display 30 to show the number of encoder pulses sensed for each pass of carriage 80. The message displayed will be "ENCODER COUNT XXX OF 243", wher "XXX" is the number of encoder pulses sensed and "243" is the total number of encoder pulses which should have been sensed. Variations in the total number of encoder pulses sensed usually will indicate a maladjusted, dirty, or damaged encoder sensor 116. Part 2 of the encoder test causes carriage 80 to move back and forth and display 30 reads HI=XX, LO=XX, where XX are numbers directly proportional to the longest and shortest time between encoder pulses. If these are not within prescribed limits, then "* ERROR *" will also be displayed. This tests for excessive speed variation of carriage mechanisms.

The MEMORY/INPUT PORT test allows a service technician to read any memory location or input port. This is done through keyboard 28 by pressing the "P" key followed by a two hexadecimal digit input port address, or by pressing a four hexidecimal digit memory address. Microprocessor 200 causes display 30 to show the contents of the address in hexadecimal form. The technican may then enter another address, or may terminate the MEMORY/INPUT PORT test by pressing the STOP key. Sequential memory addresses may be read by repeatedly pressing the RETURN key after the initial address is entered.

9. Conclusion

In conclusion, the data printing apparatus of the present invention provides reliable, highly flexible data printing of alphanumeric information on photographic slide mounts. The data printing apparatus of the present invention is compatible with a slide mounter using one-piece preclosed plastic slide mounts such as the Pakon slide mount. A wide variety of operating and diagnostic modes are provided.

Although the present invention has been described with reference to preferred embodiments, workers skilled in the art will recognize that changes may be made in form and detail without departing from the spirit and scope of the invention. For example, although the specific embodiment shown in FIGS. 2–7 uses timing belt 92 to drive carriage 80, other embodiments use a rack-and-pinion type of carriage drive.

What is claimed is:

1. Apparatus for printing alphanumeric information on photographic slide mounts, the apparatus comprising:

(a) a generally horizontal slide track along which the photographic slide mounts are advanced, the slide track having an entrance end and an exit end and including a film insertion station proximate the entrance end and a printing station between the film insertion station and the exit end;

(b) film insertion means for causing a photographic film transparency to be at least partially inserted into the slide mount at the film insertion station;

(c) mount indexing means for causing the slide mount to be indexed from station-to-station along the slide track;

(d) a frame positioned generally below the slide track which includes first and second side supports and a top platform having a printing aperture therein at the printing station of the slide track;

(e) guide means cooperating with the platform for defining the slide track from the film insertion station to the printing station;

(f) a plurality of horizontal guides supported by the frame and defining a carriage track, the horizontal guides and carriage track both being positioned below the slide track and carriage track being aligned in a plane parallel to a plane defined by the slide track and running in a generally transverse direction to the slide track;

(g) a carriage movable on the carriage track below the slide track;

(h) a print head carried by the carriage below the slide track for printing alphanumeric characters through the printing aperture of the top platform of the frame onto a bottom surface of a slide mount when the slide mount is positioned at the printing station of the slide track;

(i) carriage drive means for moving the carriage on the carriage track; and (j) control means for controlling the print head and the carriage drive means to print selected alphanumeric information on the slide mount positioned at the printing station, the control means including:

(1) means for storing data representative of the alphanumeric information to be printed on the slide mount;

(2) means for providing a carriage drive control signal to the carriage drive means to move the carriage in a selected direction on the carriage track;

(3) means for providing signal pulses representative of the incremental motion of the carriage on the carriage track, the means for providing signal pulses including:

(A) a linear optical encoder having a first end portion, a second end portion and an intermediate portion, with a plurality of lines spaced at predetermined incremental distances being carried on the intermediate portion of the linear optical encoder;

(B) optical sensor means for optically sensing the lines of the linear optical encoder and producing signal pulses as the linear optical encoder moves relative to the optical sensor means as a result of movement of the carriage on the carriage track;

(C) aperture plate means having an aperture which defines a window portion of travel of the carriage on the carriage track during which actuation of the print head is permitted; and (D) window sensor means for optically sensing the aperture and producing a signal as relative movement of the aperture occurs as a result of movement of the carriage on the carriage track; and (4) means for controlling the print head as a function of the stored data and the signal pulses, the means for controlling the print head initiating operation of the print head after a first predetermined number of signal pulses have been provided and being responsive to the signal from the window sensor means to disable the print head when the carriage is outside of the window portion of travel.

2. The apparatus of claim 1 wherein the carriage drive means comprises:

carriage drive motor means responsive to the carriage drive control signal for supplying drive power;

carriage drive belt means for transferring the drive power from the carriage drive motor means to the carriage to cause the carriage to move on the carriage track.

3. The apparatus of claim 2 wherein the carriage drive motor means is a reversible electric motor which rotates in one direction to cause the carriage to move in a first direction on the carriage track and which rotates in an opposite direction to cause the carriage to move in a second opposite direction on the carriage track; and wherein the carriage drive control signal determines the direction of rotation of the motor and thus the direction of movement of the carriage on the carriage track.

4. The apparatus of claim 1 and further comprising:

ink ribbon means positioned between the print head and the slide track at the print station; and wherein the print head comprises an array of pins which are individually actuable to strike the ink ribbon means and thus cause ink to be transferred from the ink ribbon means to a slide mount positioned at the print station.

5. The apparatus of claim 4 wherein the ink ribbon means comprises:

a first spool;

a second spool;

an ink ribbon extending along a ribbon path between the first spool and the second spool, the ribbon path including a portion in which the ribbon is positioned between the print head and the slide track at the print station;

ribbon drive means for causing the ink ribbon to be moved along the ribbon path between the first and second spools.

6. The apparatus of claim 1 and further comprising:

means for providing a signal indicating that a slide mount is in position for printing at the print station; and wherein the means for controlling the print head is responsive to the signal and disables operation of the print head if a slide mount is not in position at the print station.

7. The apparatus of claim 1 wherein the optical sensor means is in a fixed position and the linear optical encoder is mounted to and movable with the carriage.

8. The apparatus of claim 1 and further comprising:

means for adjusting the first predetermined number of signal pulses.

9. The apparatus of claim 1 and further comprising:

means for adjusting the position of the aperture plate means to adjust the relative position of the window portion.

10. The apparatus of claim 1 and further comprising:

magazine means adjacent the entrance end of the slide track for holding a stack of empty slide mounts; and slide mount collecting means adjacent the exit end of the slide track for receiving the slide mounts as they leave the exit end of the slide track.

11. The apparatus of claim 10 wherein the film insertion station is adjacent the entrance end, the printing station is adjacent the film insertion station, and a mount holding station is positioned between the printing station and the exit end.

12. The apparatus of claim 11 wherein the mount indexing means, during each operating cycle of the apparatus, pushes a lowermost slide mount out of the magazine and into the slide track to the film insertion station, thereby pushing slide mounts in the slide track to the succeeding stations.

13. The apparatus of claim 1 wherein the control means comprises:

carriage drive control means for controlling the carriage drive means as a function of a carriage control signal;

print head control means for controlling the print head as a function of a print head control signal;

program memory means for storing a digital operating program;

data memory means for storing digital data representative of the alphanumeric information to be printed; and digital processor means for providing the carriage control signal and the print head control signal as a function of the digital operating program and the stored digital data.

14. The apparatus of claim 13 and further compring:

keyboard means having a plurality of keys for providing keyboard input signals to the digital processor means;

display means controlled by the digital processor means for displaying information in human readable form; and wherein the digital processor means controls the display means and provides the carriage control signal and the print head control signal based upon keyboard input signals.

15. The apparatus of claim 14 wherein the digital processor means alters the stored signal data in the data memory means as a function of the keyboard input signals.

16. The apparatus of claim 15 wherein the operating program stored by the program memory means includes a set of instructions for each of a plurality of operating modes, and wherein the digital processor means selects one of the sets of instructions based upon the keyboard input signals.

* * * * *